United States Patent [19]

Groetschel

[11] 4,251,168

[45] Feb. 17, 1981

[54] FASTENING MEANS FOR ROOF MATS FOR MINE WORKINGS

[76] Inventor: Karl M. Groetschel, Montsalvatstrasse 1a,, D-8000 Münich, Fed. Rep. of Germany

[21] Appl. No.: 941,049

[22] Filed: Sep. 11, 1978

Related U.S. Application Data

[63] Continuation-in-part of Ser. No. 820,381, Jul. 29, 1977, Pat. No. 4,122,682.

[30] Foreign Application Priority Data

Oct. 26, 1977 [DE] Fed. Rep. of Germany ..... 2748032

[51] Int. Cl.[3] ..... E21D 11/00

[52] U.S. Cl. ..... 405/288; 411/457; 411/466; 206/343; 405/150

[58] Field of Search ..... 405/288, 150; 85/11, 85/13, 49, 17; 206/243, 244, 245, 246

[56] References Cited

U.S. PATENT DOCUMENTS

| | | | |
|---|---|---|---|
| 1,125,477 | 1/1915 | Conn | 85/17 X |
| 1,185,231 | 5/1916 | Miller | 85/11 UX |
| 1,939,631 | 12/1933 | Randall | 206/343 X |
| 2,174,708 | 10/1939 | Sears et al. | 85/17 X |
| 2,208,848 | 7/1940 | Jorgensen | 85/11 |
| 2,277,758 | 3/1942 | Hawkins | 85/13 UX |
| 2,392,159 | 1/1946 | La Place | 85/49 X |
| 2,778,266 | 1/1957 | Forrester | 85/49 |
| 2,996,237 | 8/1961 | Hines | 85/11 UX |
| 3,618,447 | 11/1971 | Goins | 85/13 X |
| 3,841,194 | 10/1974 | Moehlenpah | 85/13 |

FOREIGN PATENT DOCUMENTS

| | | | |
|---|---|---|---|
| 2438593 | 8/1976 | Fed. Rep. of Germany | 405/288 |
| 1254563 | 1/1961 | France | 405/288 |
| 44600 | 11/1961 | Poland | 405/288 |
| 746287 | 3/1956 | United Kingdom | 85/17 |
| 899119 | 6/1962 | United Kingdom | 405/288 |

*Primary Examiner*—Dennis L. Taylor
*Attorney, Agent, or Firm*—Spencer & Kaye

[57] ABSTRACT

Fastening means for mechanically fastening adjacent portions of mat material for application to the undersurface of a roof of a mine working and comprising a plurality of projecting elements for penetrating the mat material and base means connecting and spacing said projecting elements in longitudinal succession.

12 Claims, 13 Drawing Figures

FIG. 1.
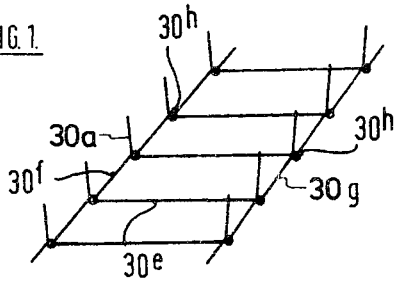
FIG. 2.
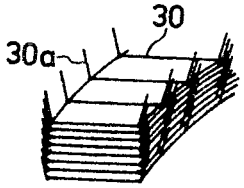
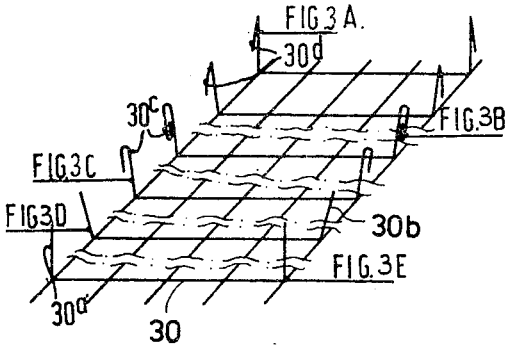
FIG. 4 A.
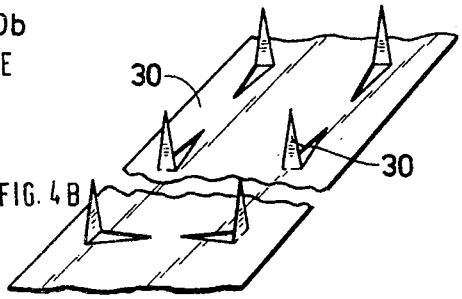
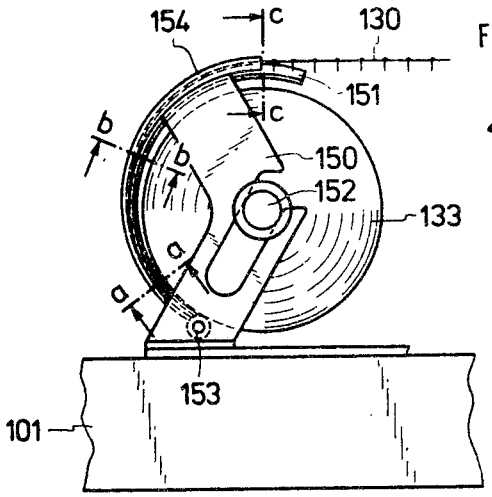
FIG. 5.

Fig. 6
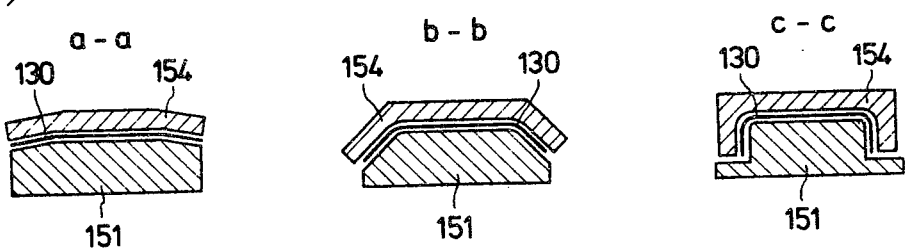
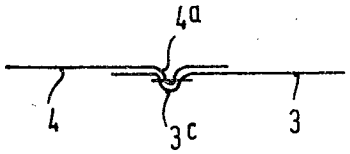
FIG. 7A
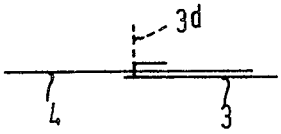
FIG 7B
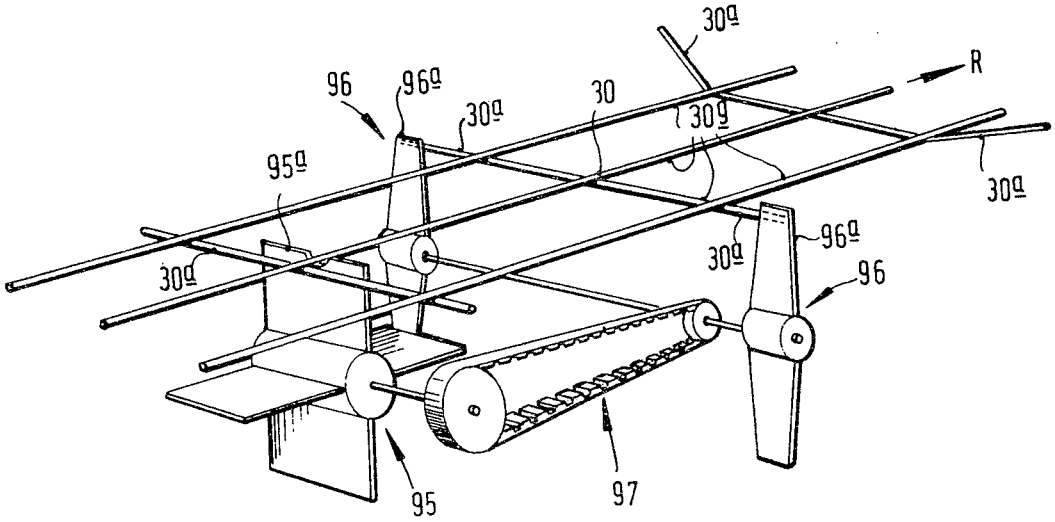
FIG. 8

FIG. 9
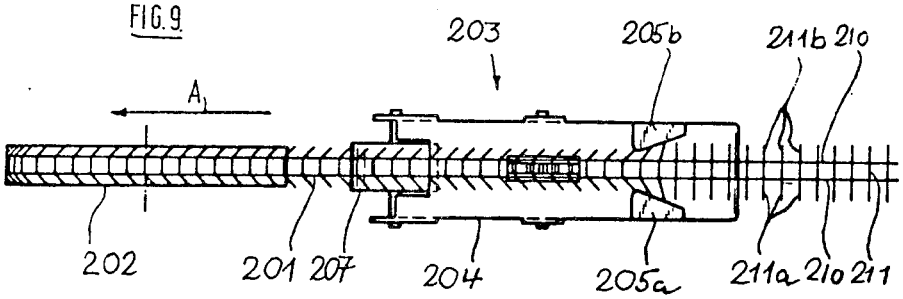
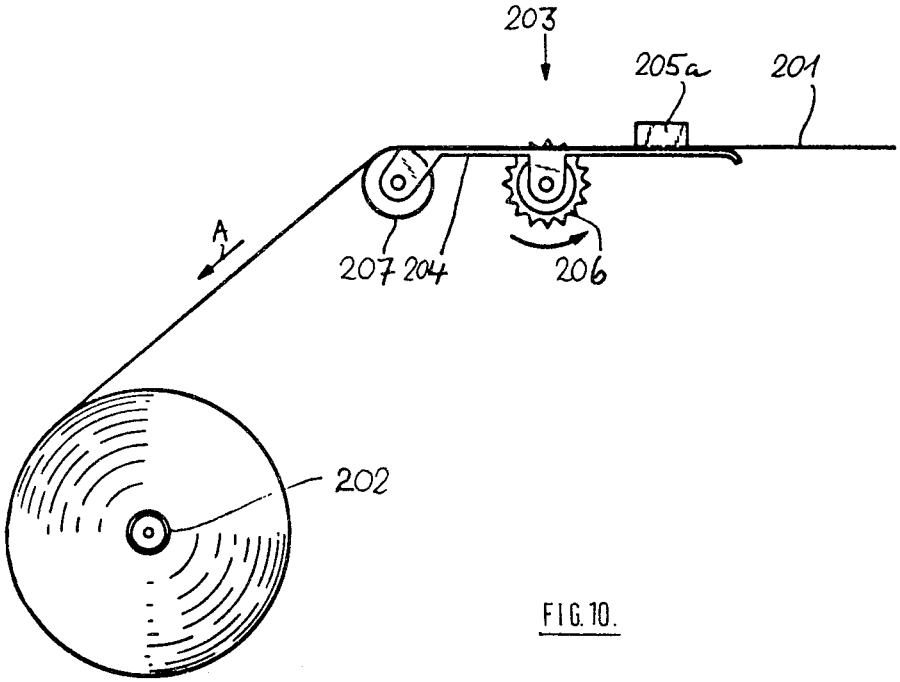
FIG. 10.

FASTENING MEANS FOR ROOF MATS FOR MINE WORKINGS

CROSS REFERENCE TO RELATED APPLICATION

This application is a continuation-in-part of co-pending application Ser. No. 820,381 filed July 29, 1977, now U.S. Pat. No. 4,122,682 issued Oct. 31, 1978.

BACKGROUND OF THE INVENTION

Field of the Invention

A method of and apparatus for installing a flexible roof mat for supporting the roof of an underground mine working is the subject of my U.S. Pat. Nos. 3,399,927 and 4,099,785. My further application for U.S. patent Ser. No. 820,381 also concerns methods of and apparatus for the installation of such roof mats and the present application is divided therefrom and specifically concerns fastening means for fastening together adjacent lengths of roof mat and also concerns a roof mat structure comprising such lengths and fastening means in combination. Further, the present application includes certain developments in fastening means additional to the fastening means disclosed in my application Ser. No. 820,381 aforesaid.

My U.S. Pat. Nos. 3,399,927 and 4,099,785 disclosed methods and forms of apparatus the use of which provided an improvement in safety of personnel working beneath the roof but did not make provision for connection between the generally parallel length or portions of mat, so that there was a risk that gaps would be left or would develop between adjacent portions of the roof mat and the safeguard offered by the mat to descent of roof material would, therefore, not be established in respect of such gaps.

To secure adjacent portions of roof mat together by manual methods involves considerable work, is expensive, and gives rise to accident risks to an extent which is undesirable in mechanised mine workings.

The principal object of the present invention is to overcome or reduce these disadvantages.

SUMMARY OF THE INVENTION

In accordance with the invention I provide fastening means for mechanically fastening adjacent portions of the mat material for application to the undersurface of the roof of a mine working, said fastening means comprising a plurality of projecting elements for penetrating the mat material, and means connecting and spacing said projecting elements in longitudinal succession.

A preferred form of such fastening means comprises a strip of wire mesh including longitudinally and transversely extending wires, at least some of said transversely extending wires having end portions forming staple pins projecting laterally outwardly of said strip beyond respective ones of the longitudinal wires adjacent to respective lateral edges of said strip; said staple pins extending each in a direction such as to define an acute included angle with said one of said longitudinal wires at the edge of said strip at which said staple pin is situated.

From yet another aspect the present invention resides in the provision of a roof mat structure for use in application against the undersurface of a mine roof comprising a plurality of strip-like portions of mat material arranged in successive laterally offset relation but with adjacent edges proximate to each other, and means on or associated operatively with said mat portions establishing a mechanical connection between them.

BRIEF DESCRIPTION OF THE DRAWINGS

The invention will now be described, by way of example, with reference to the accompanying drawings wherein:

FIG. 1 illustrates one embodiment of a fastening strip in accordance with the invention;

FIG. 2 shows lengths of the fastening element in stacked or nested relation;

FIGS. 3A to 3E illustrate further embodiments of fastening means in accordance with the invention;

FIGS. 4A and 4B illustrate still further embodiments of fastening means in accordance with the invention;

FIG. 5 is a view in side elevation illustrating a deforming device for the fastening means and which is associated with the support means for a stored supply of the fastening means;

FIG. 6 comprises diagrammatic representations of sections through different points of the device shown in FIG. 5;

FIGS. 7A and 7B show alternative ways of mutually fastening two overlapping regions of roof mat portions laid along adjacent paths;

FIG. 8 shows a device for initially bending end portions forming staple pins of a fastening strip to provide an angle of lead of such elements;

FIG. 9 is a plan view of a device for shaping a fastening means in accordance with the invention;

FIG. 10 is a view in side elevation of the device of FIG. 1;

DESCRIPTION OF THE PREFERRED EMBODIMENT

Figure 11:
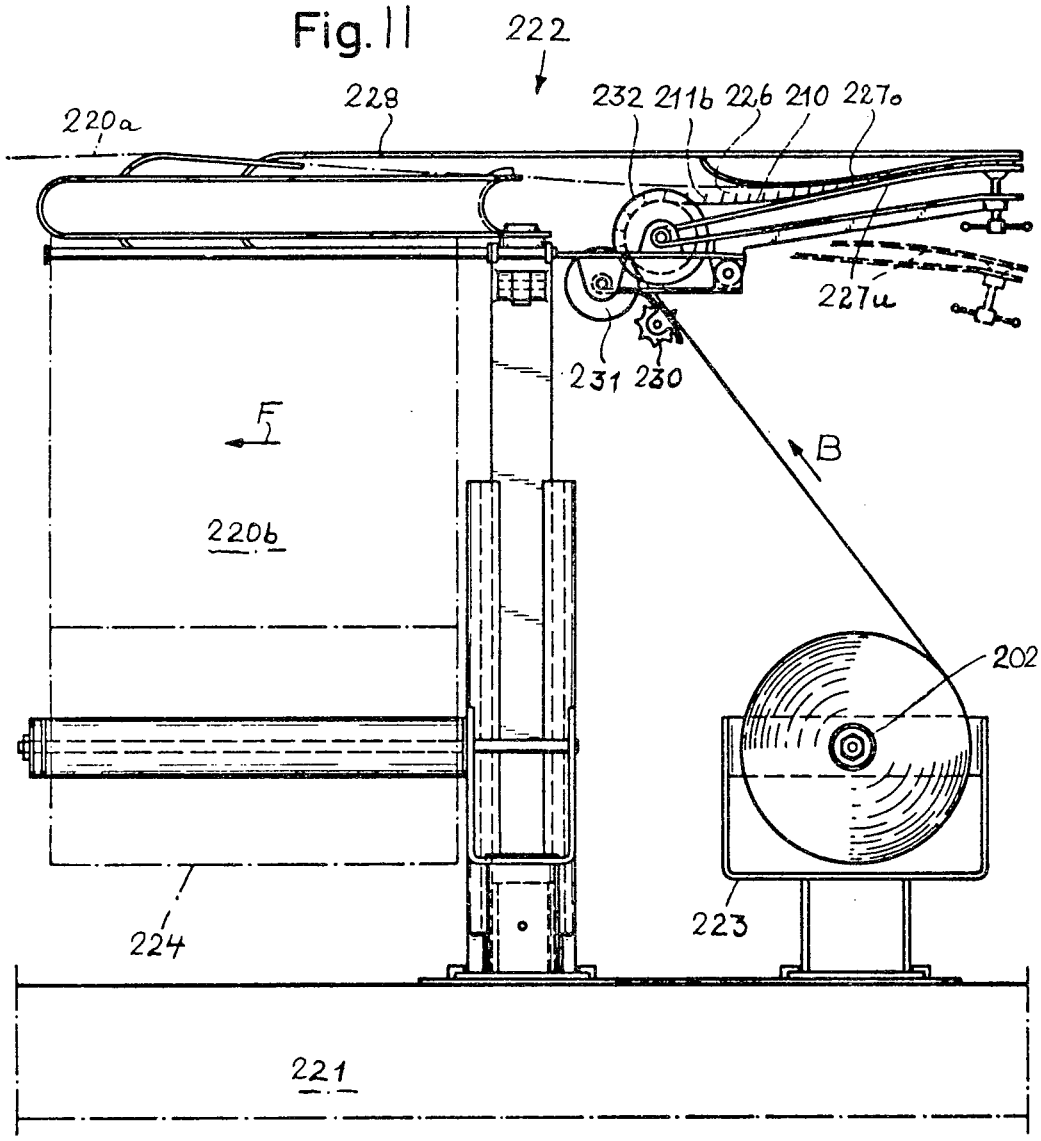
FIG. 11 is a diagrammatic view in side elevation of a roof mat applicator device with a store of coiled stapling strip forming the fastening means, and including means for effecting a second fabrication stage of the stapling strip.

The method of, and apparatus for, installing lengths of flexible roof mat material against the undersurface of a mine roof working, and the means for applying fastening means to fasten adjacent lengths of the roof matting to each other, is fully described and illustrated in my co-pending application Ser. No. 820,381 to which reference may be had as necessary and is to be considered to be part of the present disclosure.

During the installation process itself the fastening means comprising a band or strip 30 (FIG. 1) is applied to the mat portions to fasten these together. In one form the fastening strip comprises a chain. Each link of the chain may be formed of a length of wire bent to provide a cross portion 30*e*, two integral side portions 30*g* extending lengthwise of the strip parallel to each other and connected to projecting elements 30*a* by integral loops 30*h*. The strip may be of suitable width and structure incorporating projecting elements of any of a number of forms such as pins, teeth, hooks, spikes or like elements 30*a* to 30*d* and 30*i* (FIGS. 3A to 3E and 4A, 4B). The fastening strip is fed towards the junction zone of overlap between the two roof mat portions 3 and 4 which are to be fastened together. This fastening strip 30 may be a wire link chain (FIG. 1) incorporating projecting elements 30*a* in the form of wire pins extending transversely to the plane of the strip and are situated at the joints between link elements of the chain. These pins are preferably inclined by an angle of a few degrees relative to the plane of the chain links in a direction laterally outwardly (FIGS. 1 and 2). This imparts to the strip approximately the form of a divergent trough or channel formed of links (FIG. 2). Such channels can be economically stacked to occupy comparatively very little space and can also be coiled up in this form. A comparatively large supply which may be sufficient for the whole length of a working may be stored in coiled form.

The fastening strip may be formed of imperforate material as seen in FIGS. 4A, 4B, except for the apertures which are created by the spikes or like elements 30 seen in this embodiment.

The fastening means illustrated in FIGS. 3A to 3D each comprises a grid or screen-like arrangement of intersecting wires which are preferably bonded together by galvanizing or similar methods. It is envisaged that a strip of any of these forms will be initially flat, the transversely projecting portions of the cross wires being bent upwards to form the upright fastener pins in a comparatively relatively simple manner, for example by drawing the initially flat band or strip through a bending device. Such device may comprise a suitably formed die and a roll of appropriate diameter which presses the middle region of the band, which is to remain flat, into the die with a gradual transitional region to produce the desired form.

One embodiment of such a bending device is shown in FIG. 5. In this embodiment the guide part 151 forming a male die co-acts with a female die or shoe 154 extending around the guide part 151 at a small radial spacing from its outer face and secured to the holder means 150. The cross-section of the fastening strip which is drawn tangentially through the space between male and female die elements will be progressively deformed as shown in FIG. 6. In the region (a—a) behind the point of entry the edges of the fastening strip which are provided with the fastening elements are still nearly co-planar with the remaining central part of the strip. By the time the strip emerges from the space between the dies of the device it will have taken up its final shape, for example (c—c) wherein the fastening elements are erect and ready for operative engagement with the roof mat portions.

It is desirable that at the time of penetration of the mat portions by the staple pins or projections of the fastening strip, the latter should be as nearly as possible at right angles to the plane of the mat portions to facilitate penetration if the latter is made of, or includes, imperforate material such as foil, or to facilitate passage through apertures of the mesh if the mat material is composed wholly of wire mesh. The included angle between the fastening strip and the mat portions would be an acute angle normally having a value less than 45°, for example of the order of 20°, and it is, therefore, desirable that the pins or other projections should have an angle of lead appropriate to this value with respect to the remainder of the fastening strip, i.e. they should be inclined backwardly with respect to the direction of travel and towards the point at which the fastening strip and the mat portions meet each other.

For this purpose a device may be included in the embodiments of apparatus hereinbefore described for bending the outer end portions of transverse elements of the fastening strip in an appropriate direction while remaining in the plane of the fastening strip preparatory to the latter being deformed by the device shown in FIG. 5 or its equivalent.

For this purpose a further deforming device may be provided, one embodiment of which is illustrated in FIG. 8.

In this embodiment transverse elements of the strip have central portions 30*e* which are integral with laterally projecting pin forming portions 30*a* and lie in the same plane as longitudinal members 30*g* which are welded to the transverse members. The central portions 30*e* act as driving members when the strip is drawn forward in the direction of arrow R and engage with the blades or teeth of a driving element such as a gear wheel or paddle wheel 95 to cause this to be rotated intermittently or continuously depending upon the longitudinal pitch between the elements 30*e* and the number of teeth or paddle blades.

A pair of driven elements 96 are provided adjacent to the lateral margins of the fastening strip, these being in the form of gears or paddle wheels having teeth or blades engaging with the pin-forming portions 30*a*.

The driven elements 96 are driven at a higher speed than the speed of rotation of the driving element 95 so that the pin-forming elements 30*a* are bent forwardly in the direction of travel R, power for this purpose being derived from the tractive effort applied to the stored portion or coil of fastening strip as the apparatus is advanced with the coal cutting machine.

The number of teeth or blades and the gear ratio of a chain and sprocket drive or other suitable transmission means 97 positively connecting the driving and driven elements is selected to ensure the requisite degree of bending of the elements 30*a* and to maintain a proper phase relation between the teeth or paddles of the driving and driven elements so that, when a given tooth or paddle 95*a* of the driving element is just in front of an associated transverse element 30*e*, teeth or paddles 96*a* are just behind the extremities of pin-forming portions 30*a*. In the particular example driving element shown as having four teeth or paddles, and the driven element as two, while the gear ratio provided by the transmission means 97 may be 2:1.

In use the device illustrated in FIG. 8 may be interposed between a coil, such as 133, (FIG. 5) of fastening strip having its pin-forming portions 30*a* coplanar with the remainder of the strip and colinear with the transverse portions 30*e* and the strip drawn off from this coil may be passed through the device shown in FIG. 8 and then between the male and female dies 151, 154 of the device shown in FIG. 5, whereby the pin-forming portions are bent into a position transverse to the plane of the remainder of the strip but retain an angle of lead due to the positions to which they will have been bent by the driven elements 96.

Referring now to FIG. 9, fastening means in the form of a stapling strip 201 is, prior to being coiled on a reel 2, conducted through a deforming station 203 which, in the illustrated example, comprises a guide and supporting plate 204, a pair of relatively spaced apart bending tools 205*a*, 205*b* mounted on said plate, a driving cog 206 which engages positively in the mesh of the stapling strip and pulls or draws the strip through the bending tools 205*a*, 205*b*, and a reversing, or direction-changing roller 207. The cog 206 may be dispensed with if the rotary drive for the reel 2 is suitably designed and dimensioned.

It will be apparent from FIG. 9 that the basic strip 201 is fed to the deforming station 203 in the form of a strip of plain wire mesh comprising the wires 210 and 211 which intersect each other in the manner of a grid and are preferably tied or joined together at the points of intersection by galvanizing or in a similar manner. Wire grids of this configuration are extremely easy to make. As the strip enters into the gap between the bending tools 205*a*, 205*b*, here in the form of stationary dies, the freely outwardly protruding ends 211*a* and 211*b* of the cross wires 211 on both sides of the strip are engaged by the ramp-like bending dies 205*a*, 205*b* and bent obliquely rearwards in the strip plane oppositely to the direction of advancement A of the strip 1. In other words, the free wire ends 211*a*, 211*b* which are provided to act as actual staple means or staple pins, leave the gap between the two bending dies 205*a* and 205*b* with a wedge-like setting angle clearly visible in FIG. 9, including, for example, an acute angle of 45° with the longitudinal wires 210 in the strip.

The reversing or direction-changing roller 207 which is provided in succession with the driving cog 206 and also mounted on the guide and supporting plate 204, comprises a cylindrical outer circumferential surface which, pulls the stapling strip 201 with the angled free wire ends 211*a* and 211*b* flat in the transverse direction thereby, in view of the tension in the strip, maintaining the angled wire ends in the main plane of the strip. In this form, that is to say in the form of a flat strip, the stapling strip can be very easily and economically coiled on the reel 202 to take up a minimum of space and can also be drawn off the reel again with equal ease and without any risk of obstruction by potentially interengaging or tangling wire ends, in the opposite direction.

In other words, the wedge-like angling of the wire ends 211*a* and 211*b* is simply incorporated in the process of coiling the strip 201 on the reel 202 and requires no extra time. It will also be seen that the deforming station is of extremely simple design and construction.

Figure 12:
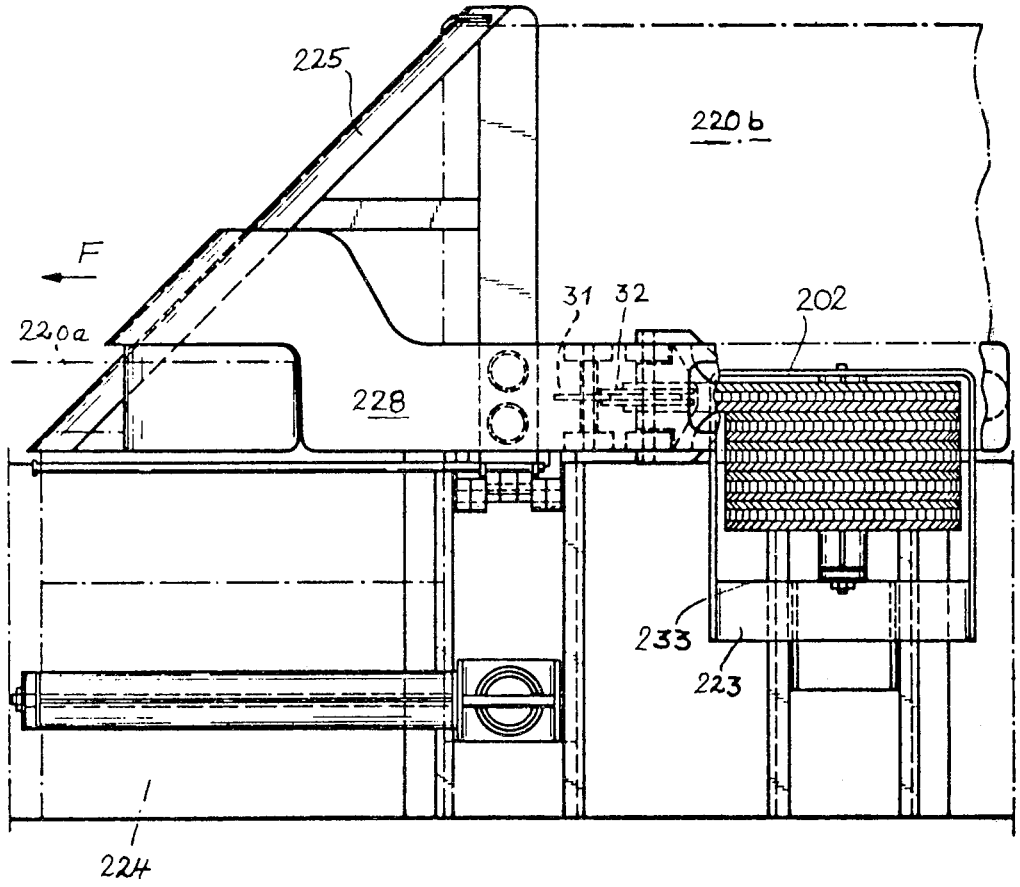
FIG. 12 is a plan view of the applicator and components shown in FIG. 11.

FIGS. 11 and 12 illustrate a further fabrication stage for shaping the stapling strip 201, wherein the free ends 211*a* and 211*b* of the cross wires 211 which extend initially flat in the strip plane are raised up to assume the correct position for penetration into the roof matting bands (FIG. 11). This further deformation process is applied immediately prior to the actual application of the strip 201 for stapling the newly laid band of roof matting 220*b* to the adjoining previously laid band 220*a*.

The means for laying the roof mats parallel with the working face are diagrammatically represented in FIGS. 11 and 12 and not a subject of the present invention. The following description is confined to those parts of the device which are significant with regard to the description of the stapling strip, its shaping and operative stapling engagement in the marginal zones of the adjoining roof mat bands 220*a* and 220*b* which are to be stapled together.

In the illustrated example, the roof mat applicator or laying device 222 shown in side elevation in FIG. 11, and in plan in FIG. 12, is mounted together with a support 223 for the stapling strip coils 202, on the coal-getting machine 221, the latter being merely indicated by dot-and-dash lines. The new roof mat band 220*b* which is about to be laid is drawn off a coil 224, redirected into the correct position parallel with the face of the working by a deflector device fitted on the vertically adjustable upper part of the mat applicator device 222, and conducted with marginal overlap beneath the previously laid roof mat band 220*a* into the working gap 226 between upper and lower press dies 227*o*, 227*u*. The lower die 227*u* is adapted to be folded down as indicated by broken lines in FIG. 11. A die holder 228 which carries the upper die 227*o* and partially embraces the deflector device is provided with a cut-out at the entrance end of the previously laid roof mat band 228*a*, to permit unimpeded entering of roof mat band 220*a* in the region between the dies, that is to say into the gap 226 as the coal-getting machine travels forwards in direction of arrow F.

The forces required to draw the stapling strip 201 off the coil 202, as well as those needed for laying the roof mat band and controlling the synchronised stapling together of the edges of adjacent roof mat bands, may be derived from the conveyor or transporter means 221 associated with the coal-getting machine. In the illustrated example, an additional gear wheel or cog 230 is provided which engages in the grid or mesh of the stapling strip 201 and, being mounted on the vertically adjustable upper part of the roof mat applicator device 222, maintains the stapling strip correctly aligned.

In the region where the stapling strip 201 is redirected to enter into the gap 26 between the press dies 227*o*, 227*u*, there is provided a pair of complementary deforming tools comprising two freely rotatable complementary rolls with a working gap of substantially U-configuration into which enters the stapling strip 201. One of these rolls is a male die 231 whilst the other roll 232 which directs the strip 201 into the working gap 226, is a female die. The working gap between these rolls is dimensioned in such a way that the free cross wire ends which point obliquely forwards in the strip plane, that is to say in the direction of arrow B after the strip is drawn off the coil 202, are now raised up from the strip plane as shown in FIG. 11. Oppositely directed friction forces generated during the deformation process in the working gap between the two rolls 231, 232 can at most cause an increase in the value of the acute angle included between the staple pins 211*b* and the longitudinal wires 210, shown in FIG. 11, but are not strong enough to reverse the obliquely forward orientation of the pins 211*b*, that is to say increasing the said angle to a value in excess of 90°. Consequently the wire ends which have been raised up in the gap between the dies 231 and 232 enter into the working gap 226 in an erect and slightly forwardly inclined position which gives them optimum advantage for penetrating into the marginal roof mat zones of adjoining roof mat bands in order to staple these securely together. Between the continuously closing press dies 227*o* and 227*u* the staple pins 211*b* which are now engaged in the marginal zones of the roof mat bands are splayed out and virtually "meshed in." The effective clip-like staple action of the staple pins which are turned over after penetrating through the roof matting may be further improved by providing an irregular non-level surface on these wire ends or staple pins, e.g. by localised bulges, corrugations or the like.

The coil holder 223, shown in FIG. 11 as being mounted on the base or support plate, may be alternatively accommodated in the vertically adjustable upper part of the roof mat applicator device 222, for example just beneath the press dies 227*o*, 227*u*. Thanks to the simple and space-saving method and form of coiling the stapling strip 201 on narrow reels 202, which has been provided by the present invention, it is also possible and advisable, as shown in FIG. 12, to fit several staple strip coils on a common axis 233 of the coil holder device 223, so that when one coil has been used up the next coil can be ready for further supply of stapling strip without loss of valuable time.

Figure 13:
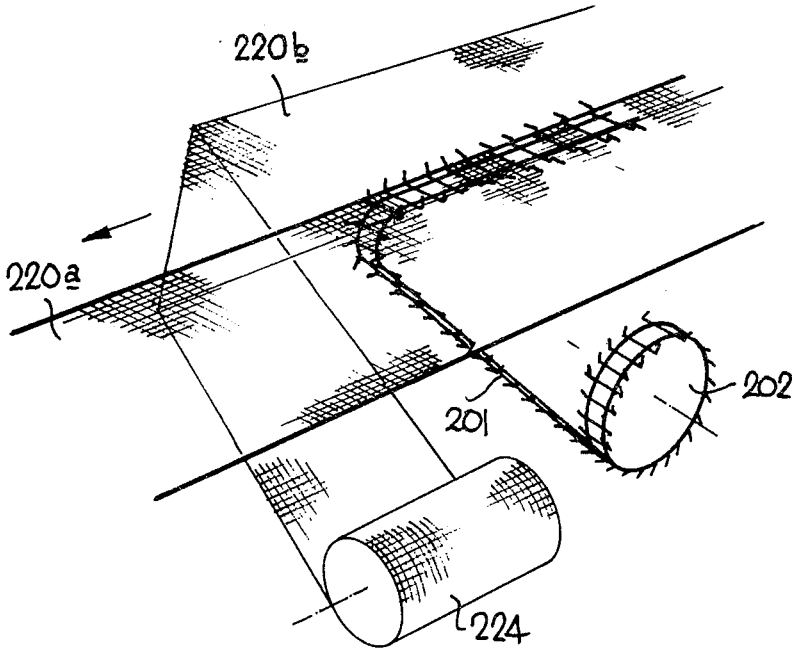
FIG. 13 illustrates diagrammatically the process of fastening together adjacent lengths of roof mat by the apparatus of FIG. 11, the apparatus being omitted for clarity of illustration.

The process of applying the stapling strip 201 to the adjacent marginal portions of the existing mat 220*a* and newly laid mat 220*b* is illustrated in FIG. 13. This process is performed by the apparatus shown in FIGS. 11 and 12 but the apparatus has been omitted from FIG. 13 for clarity of illustration. In FIG. 13, there can be clearly seen the free end portions of cross wires 211 which form the staple pins 211*a* and 211*b*. These end portions are raised up from the plane of the remainder of the stapling strip 201 and then penetrate through the mats 220*a* and 220*b* as the stapling strip is directed against the underside of the mats. The pins are then turned over to establish a secure mechanical connection between the mats 220*a* and 220*b*.

I claim:

1. A fastener strip for mechanically fastening adjacent portions of mat material for lining and supporting a roof surface of a mine working and comprising:

a. base means of elongate form and comprising a strip of mesh material having sufficient flexibility to admit of coiling, b. pin-like mat penetrating means carried by the base means at intervals along its length and in combination with the base means defining a profile, as viewed endwise on to the fastener strip, admitting of coiling of the fastener strip with successive layers of the base means in close or contiguous relation, and wherein, the pin-like mat penetrating means comprises two rows of staple pins situated adjacent to respective lateral edges of the base means and spaced apart from each other therealong, and the staple pins are formed by limbs of the mesh which terminate in free ends presented at the lateral edges of the strip of mesh material, and are inclined with respect to the base means in a direction such that they all point towards the same end of the fastener strip.

2. The fastener strip according to claim 1 wherein the staple pins lie in substantially coplanar relation with the base means with the staple pins at opposite edges of the base means pointing in opposite lateral directions but being deformable into erect mat penetrating positions in which they define a channel shape for said profile.

3. The fastener strip according to claim 1 wherein said profile is of channel shape with the staple pins of one of said rows being laterally divergent with respect to those of the other of said rows in a direction from the base means towards the mouth of the channel to an extent such that successive turns of the fastener strip can nest when it is coiled.

4. A fastener strip for mechanically fastening adjacent portions of mat material for lining and supporting a roof surface of a mine working and comprising a strip of wire mesh including longitudinally and transversely extending wires, the latter including end portions projecting to form staple pins at intervals along opposite edges of the strip, and the configuration of the strip as viewed endwise defining a profile admitting of coiling the strip into a form in which successive coils are in close or contiguous relation and wherein the staple pins point obliquely to the longitudinal wires all towards the same end of the strip.

5. The fastener strip according to claim 4 wherein the staple pins define in combination with the remaining portions of the transverse wires a channel shape as the strip is viewed endwise and the staple pins diverge from each other in a direction from the base of the channel towards its mouth.

6. The fastener strip according to claim 4 wherein the staple pins are substantially coplanar with the longitudinal wires.

7. The fastener strip according to claim 6 wherein the staple pins each project in a direction laterally outwardly beyond that one of the longitudinal wires situated adjacent to the same lateral edge as that at which the staple pin lies and defines an acute included angle having a value of 45° or greater with that longitudinal wire.

8. The fastener strip according to claim 4 wherein said longitudinal and transverse wires are substantially at right angles to each other.

9. The fastener strip according to claim 4 wherein said staple pins have surface irregularities.

10. In an underground mine working a roof mat structure lining and supporting a roof surface of said underground mine working and comprising:

a. a plurality of elongate strip-like portions of mat material arranged in laterally offset relation but with respective lateral edges proximate to each other, and b. strip-like fastener means arranged along each of the proximate edges and overlapping with margins of adjacent portions of the mat material bordering such edges, the fastener means having staple pins penetrating the respective margins with the staple pins deformed to have an interlocked relation with the margins.

11. The roof mat structure according to claim 10 wherein the portions of mat material and the fastener strip are formed of wire mesh, the latter having wires of which end portions project transversely of its length adjacent to respective lateral edges of the fastener strip and form said staple pins.

12. The roof mat structure according to claim 10 wherein the fastener strip comprises at least two longitudinally extending wires and a plurality of transversely extending wires having end portions projecting beyond respective ones of the longitudinal wires situated adjacent to lateral edges of the strip and forming the staple pins.

* * * * *